US006060108A

United States Patent [19]

Burd et al.

[11] Patent Number: 6,060,108

[45] Date of Patent: May 9, 2000

[54] METHOD FOR REVEALING HIDDEN WATERMARKS

[75] Inventors: James E. Burd, Saxonburg; Lee H. Leiner, New Kensington; Robert M. Gaydos, Export, all of Pa.

[73] Assignee: Preservation Technologies, L.P., Cranberry Township, Pa.

[21] Appl. No.: 09/143,285

[22] Filed: Aug. 28, 1998

[51] Int. Cl.[7] ..... B41M 3/14; B05D 5/00

[52] U.S. Cl. ..... 427/7; 427/271; 427/288; 427/145

[58] Field of Search ..... 427/7, 271, 288, 427/395, 145

[56] References Cited

U.S. PATENT DOCUMENTS

| | | | |
|---|---|---|---|
| 650,901 | 6/1900 | Kretschmann . | |
| 1,589,210 | 6/1926 | Murray . | |
| 2,445,586 | 7/1948 | Simons . | |
| 3,672,935 | 6/1972 | Miller et al. | 117/36.8 |
| 3,903,329 | 9/1975 | Kay et al. | 427/145 |
| 3,989,279 | 11/1976 | Levy . | |
| 4,037,007 | 7/1977 | Wood . | |
| 4,891,505 | 1/1990 | Jalon . | |
| 5,118,526 | 6/1992 | Allen et al. | 427/161 |
| 5,139,572 | 8/1992 | Kawashima . | |
| 5,409,736 | 4/1995 | Leiner et al. | 427/372.2 |
| 5,814,579 | 9/1998 | Dotson et al. | 503/201 |
| 5,856,286 | 1/1999 | Nalewajek et al. | 510/288 |

FOREIGN PATENT DOCUMENTS

| | | |
|---|---|---|
| WO 86/02855 | 5/1986 | WIPO . |

OTHER PUBLICATIONS

Kirk Othmer Encyclopedia of Chemical Technology, "Fluorinated Aliphatic Compounds," vol. 11, pp. 499–521, Jan. 1994.

*Primary Examiner*—Shrive Beck
*Assistant Examiner*—Jennifer Calcagni
*Attorney, Agent, or Firm*—Kirkpatrick & Lockhart LLP

[57] ABSTRACT

A method for temporarily revealing the presence of a watermark on cellulose-based materials. The method comprises applying one of a perfluorocarbon ard hydrofluorocarbon to at least a portion of the cellulose-based material. The method also provides applying a solution containing both perfluorocarbon and hydrofluorocarbon to the cellulose-based material to vary the rate of evaporation of the solution.

30 Claims, No Drawings

METHOD FOR REVEALING HIDDEN WATERMARKS

CROSS REFERENCE TO RELATED APPLICATIONS

Not Applicable.

STATEMENT REGARDING FEDERALLY SPONSORED RESEARCH OR DEVELOPMENT

Not Applicable.

BACKGROUND OF THE INVENTION

1. Field of the Invention

The present invention is directed generally to a method for detecting the presence of a watermark in cellulose-based material and, more particularly, to a method of applying a perfluorocarbon and/or hydrofluorocarbon compound to paper for temporarily revealing a watermark.

2. Description of the Background

Stamps and other documents made for special purposes, particularly official purposes, often have a watermark on or in cellulose-based material that is not clearly visible to the unaided eye. Generally, the watermark is made by mechanically pressing or forming the paper, or by applying a chemical additive in the paper manufacturing process. This indelible mark is added for identification, verification, or other official purposes, and prevents illegal activities such as, for example, tampering, counterfeiting or forgery.

Detection of the presence of a watermark is generally accomplished through the aid of chemical additives. Numerous patents are directed to invisible chemical watermarks that can be subsequently detected by the addition of a reagent to the cellulose material that will change the color of the watermark to make it visible.

For example, U.S. Pat. No. 5,139,57 to Kawashima discloses the use of a colorless ink containing at Least one color changing agent which changes to a visible color upon the application of a color former. The color changing agents can be pH indicators having a colorless pH range. Kawashima, however, discloses several complex agents that allow the watermarks to fade at different rates of speed.

U.S. Pat. No. 2,445,586 to Simons discloses a coating for paper or other articles that permanently changes color when moisture is applied. The coating is preferably a dye that has been decolorized by an alkaline earth hydroxide but wherein the color is restored when moistened.

U.S. Pat. No. 1,589,210 to Murray discloses an invisible reagent that is placed on or in paper which changes color when an ink eradicator is applied or mechanical erasure is employed. When an ink eradicator containing acid or a bleaching agent is subsequently applied to the paper a color is permanently developed. Where such paper is written or printed upon with acid ink and mechanical erasure is employed a color is again developed in the paper under the ink.

In addition, it is known to use carbon tetrachloride, benzene, hexane, lighter fluid and other reagents for revealing a watermark. However, use of these chemicals is undesirable due to the health concerns associated with their application. In addition, these chemicals tend to obscure the watermark, which appeers mottled when revealed.

Accordingly, the prior art patents disclose chemicals and their method of application that pose health concerns, ineffectively reveal the mark, dissolve ink or otherwise damage the document, are relatively complex, and/or permanently reveal the watermark. These drawbacks are particularly undesirable for revealing watermarks in collectibles such as stamps and the like.

Therefore, the need exists for a simple method of temporarily revealing a watermark at varying rates of speed, parlicularly useful for collectible documents such as stamps and the like, that clearly reveals the mark, does not damage the document, and is safe to use.

BRIEF SUMMARY OF THE INVENTION

The present invention is directed to a method for revealing the presence of a watermark on cellulose-based materials. The method comprises applying one of a perfluorocarbon and hydrofluorocarbon solution to at least a portion of the cellulose-based material.

A second method of treating cellulose material for revealing a watermark is also disclosed, the method comprising applying a solution of perfluorocarbon and hydrofluorocarbon to at least a portion of the cellulose-based material.

A third method of treating cellulose-based material for revealing a watermark is also disclosed, the method comprising applying a solution of perfluorocarbon and hydrofluorocarbon to at least a portion of said cellulose-based material, the perfluorocarbon being present in the solution in an amount greater than 0% by weight, the hydrofluorocarbon being present in the solution in an amount less than 100% by weight.

These and other advantages and benefits of the present invention will become apparent from the description of the preferred embodiments hereinbelow.

BRIEF DESCRIPTION OF THE SEVERAL VIEWS OF THE DRAWING

Not Applicable.

DETAILED DESCRIPTION OF THE INVENTION

The present invention is directed to a method for temporarily revealing the presence of a watermark on cellulose-based materials. The cellulose material may take the form of cloth, paper, parchment, or other fibrous materials. The present invention is particularly useful when applied to security documents or collectibles, such as stamps. Any type of stamp mays be used such as, for example, photogravure, lithographed, and engraved. It is contemplated that the present invention may also be used in fabric materials and textiles, whether natural or man made.

The method of the present invention, generally, provides for applying perfluorocarbon and/or hydrofluorocarbon compounds to the cellulose-based material for revealing the watermark. The perfluorocarbon compound can be, for example, perfluoroalkane, perfluoroamine, or perfluoromorpholine. The hydrofluorocarbon carbon can be, for example, a hydrofluoroether.

The perfluorocarbon and hydrofluorocarbon may be mixed at any percentage to form a reagent, as all proportions of these constituents tested have been shown to work equally well for revealing the watermark. For example, various weight ratios of hydrofluorocarbon to perfluoroalkane have been tested, including 50:50, 100:0, 0:100, 95:5, 5:95, producing similar results. Various amounts of each constituent may be added, however, to vary the rate of evaporation of the solution, although the clarity of the watermark is generally unaffected. For example, more hydrofluorocarbon may be added to provide a relatively fast evaporation rate, such as, for example, when the user is only interested in quickly determining the presence of a watermark. Likewise, more perfluorocarbon may be added to provide a relatively slow evaporation rate, such as, for example, when the user is interested in studying and examining the watermark after the watermark is revealed. Preferably, the present invention uses a mixture of 95% by weight hydrofluoroether and 5% by weight perfluoroalkane. The hydrofluorocarbons and perfluorocarbons are available from various commercial suppliers. Specifically, hydrofluoroether is available under the trade names HFE 7100 and HFE 7200, sold by Minnesota Mining & Mfg. Co. Some perfluorocarbons are available under the trade names PF 5060 (perfluorohexane), PF 5070 (perfluoroheptane), PF 5080 (perfluorooctane), and PE 5052 (perfluoromorpholine), all sold by Minnesota Mining & Mfg. Co.

The reagent of the present invention may be applied to the cellulose-based material by any suitable means, such as, for example, by immersing the cellulose-based material into a bath of the reagent solution, by direct application of the reagent to the cellulose-based material via a roller or brush, by spaying the reagent onto the cellulose-based material, or by any other application known in the art. Where the cellulose-based material is a stamp, preferably, the stamp is placed face down in a stamp watermark tray and covered completely with the product.

When the reagent is applied to the cellulose-based material, the watermark, if present, will appear immediately. Where a stamp is used, the stamp is preferably removed from the watermark tray by stamp tongs and placed on a clean surface. Evaporation of the reagent from the stamp occurs rapidly, within approximately one minute when the preferred reagent is employed.

The reagent of the present invention reveals the watermark and evaporates from the cellulose material at rates similar to other watermark reagents known in the art such as, for example, benzene, hexane, or solvent naptha. When compared to these reagents, however, the reagent of the present invention is virtually non-toxic, generates less fumes and odors, is nonflammable, reduces environmental concerns with respect to ozone depletion and global warming, and has a very low degree of solvency. With respect to this latter advantage, the low solvency of the reagent of the present invention reduces or eliminates the damage to the document. Moreover, when the watermark appears, it is relatively more pronounced with less translucence effects. This is important with hard to see watermarks, particularly where interference, such as cancellation marks, can cause viewing difficulties. When the reagent of the present invention dries, the watermark is no longer visible. Accordingly, the present invention is particularly useful in revealing watermarks on collectibles such as stamps, security documents, and the like, where damage to the document must be held to a minimum.

Those of ordinary skill in the art will recognize that many modifications and variations of the present invention may be implemented. The foregoing description and the following claims are intended to cover all such modifications and variations.

What is claimed is:

1. A method of treating cellulose-based material having a watermark for revealing said watermark, said method comprising applying one of a perfluorocarbon and hydrofluorocarbon to at least a portion of said cellulose-based material to temporarily reveal said watermark.

2. The method of claim 1 wherein said perfluorocarbon is selected from the group consisting of perfluoroalkane, perfluoroamine, and perfluoromorpholine.

3. The method of claim 1 wherein said hydrofluorocarbon is hydrofluoroether.

4. The method of claim 1 wherein said perfluorocarbon is perfluoroalkane.

5. The method of claim 4 wherein said perfluoroalkane is selected from the group consisting of perfluorohexane, perfluoroheptane, and perfluorooctane.

6. The method of claim 1 wherein said watermark is mechanically applied to said cellulose-based material.

7. The method of claim 1 wherein said cellulose-based material is one of paper, textile, and fabric.

8. The method of claim 1 wherein said cellulose-based material is a stamp.

9. The method of claim 1 wherein said applying occurs via spraying.

10. The method of claim 1 wherein said applying occurs via one of rolling, spreading, and brushing.

11. The method of claim 1 wherein said applying occurs via immersion.

12. A method of treating cellulose-based material having a watermark for revealing said watermark, said method comprising applying a solution of perfluorocarbon and hydrofluorocarbon to at least a portion of said cellulose-based material to temporarily reveal said watermark.

13. The method of claim 12 wherein said perfluorocarbon is selected from the group consisting of perfluoroalkane, perfluoroamine, and perfluorcmorpholine.

14. The method of claim 12 wherein said hydrofluorocarbon is hydrofluoroether.

15. The method of claim 12 wherein said perfluorocarbon is perfluoroalkane, said perfluoroalkane selected from the group consisting of perfluorohexane, perfluoroheptane, and perfluorooctane.

16. The method of claim 12 wherein said cellulose-based material is one of paper, textile, and fabric.

17. The method of claim 12 wherein said cellulose-based material is a stamp.

18. The method of claim 12 wherein said perfluorocarbon and hydrofluorocarbon are mixed by weight in a range of about 5% perfluorocarbon to about 95% hydrofluorocarbon.

19. The method of claim 18 wherein said perfluorocarbon is perfluoroalkane and said hydrofluorocarbon is hydrofluoroether.

20. The method of claim 12 wherein said applying occurs via one of spraying, rolling, spreading, brushing and immersion.

21. A method of treating cellulose-based material having a watermark for revealing said watermark, said method comprising applying a solution of perfluorocarbon and hydrofluorocarbon to at least a portion of said cellulose-based material to temporarily reveal said watermark, said perfluorocarbon being present in said solution in an amount greater than 0% by weight, said hydrofluorocarbon being present in said solution in an amount less than 100% by weight.

22. The method of claim 21 wherein said perfluorocarbon and said hydrofluorocarbon are present in a weight ratio of about 95:5.

23. The method of claim 21 wherein said perfluorocarbon and said hydrofluorocarbon are present in a weight ratio of about 50:50.

24. The method of claim 21 wherein said perfluorocarbon and said hydrofluorocarbon are present in a weight ratio of about 5:95.

25. A method of treating cellulose-based material having a watermark for revealing said watermark, said method comprising applying one of a perfluorocarbon and hydrofluorocarbon to at least a portion of said cellulose-based material to temporarily reveal said watermark, said perfluorocarbon being a perfluoroalkane selected from the group consisting of perfluorohexane, perfluoroheptane, and perfluorooctane.

26. A method of treating cellulose-based material having a watermark for revealing said watermark, said method comprising applying a solution of perfluorocarbon and hydrofluorocarbon to at least a portion of said cellulose-based material to temporarily reveal said watermark, said perfluorocarbon being a perfluoroalkane selected from the group consisting of perfluorohexane, perfluoroheptane, and perfluorooctane.

27. A method of treating cellulose-based material having a watermark for revealing said watermark, said method comprising applying a solution of perfluorocarbon and hydrofluorocarbon to at least a portion of said cellulose-based material to temporarily reveal said watermark, wherein said perfluorocarbon is perfluoroalkane and said hydrofluorocarbon is hydrofluorether.

28. A method of treating cellulose-based material having a watermark for revealing said watermark, said method comprising applying a solution of perfluorocarbon and hydrofluorocarbon to at least a portion of said cellulose-based material to temporarily reveal said watermark, said perfluorocarbon and hydrofluorocarbon being mixed by weight in a range of about 95% perfluorocarbon to about 5% hydrofluorocarbon.

29. A method of treating cellulose-based material having a watermark for revealing said watermark, said method comprising applying a solution of perfluorocarbon and hydrofluorocarbon to at least a portion of said cellulose-based material to temporarily reveal said watermark, said perfluorocarbon and hydrofluorocarbon being mixed by weight in a range of about 50% perfluorocarbon to about 50% hydrofluorocarbon.

30. A method of treating cellulose-based material having a watermark for revealing said watermark, said method comprising applying a solution of perfluorocarbon and hydrofluorocarbon to at least a portion of said cellulose-based material to temporarily reveal said watermark, said perfluorocarbon and hydrofluorocarbon being mixed by weight in a range of about 5% perfluorocarbon to about 95% hydrofluorocarbon.

* * * * *

UNITED STATES PATENT AND TRADEMARK OFFICE

CERTIFICATE OF CORRECTION

PATENT NO. : 6,060,108
DATED : May 9, 2000
INVENTOR(S) : Philip L. Gleckman

It is certified that error appears in the above-identified patent and that said Letters Patent is hereby corrected as shown below:

Title page,
Item [57], ABSTRACT,
Line 3, delete “ard” and replace with -- and --.

Column 1,
Line 37, delete “5,139,57” and replace with -- 5,139,572 --.

Column 2,
Line 7, delete “parlicularly” and replace with -- particularly --.
Line 47, delete “mays” and replace with -- may --.

Column 3,
Line 14, delete “PE” and replace with -- PF --.

Column 4,
Line 27, delete “perfluorcmorpholine” and replace with -- perfluoromorpholine --.

Signed and Sealed this

Twentieth Day of January, 2004

JON W. DUDAS
*Acting Director of the United States Patent and Trademark Office*